United States Patent [19]

Cole

[11] 4,275,827

[45] Jun. 30, 1981

[54] ROLLED MATERIAL GUIDE AND CUTTER

[76] Inventor: Branham F. Cole, 2345 Griffith Park Blvd., Apt. 3, Los Angeles, Calif. 90039

[21] Appl. No.: 68,815

[22] Filed: Aug. 22, 1979

[51] Int. Cl.[3] ..... B26F 3/02

[52] U.S. Cl. ..... 225/77; 225/88; 225/91

[58] Field of Search ..... 225/67–71, 225/75, 77, 80, 88–91

[56] References Cited

U.S. PATENT DOCUMENTS

| | | | |
|---|---|---|---|
| 391,609 | 10/1888 | Henderson | 225/90 X |
| 1,512,849 | 10/1924 | Isham | 225/67 |
| 2,331,791 | 10/1943 | Noel | 225/77 X |
| 2,832,549 | 4/1958 | Youngberg | 225/69 |
| 2,892,596 | 6/1959 | Fishel et al. | 225/89 X |
| 2,973,891 | 3/1961 | Scheuer et al. | 225/71 X |
| 4,042,159 | 8/1977 | Tucky | 225/77 X |
| 4,191,317 | 3/1980 | Harkins | 225/77 |

*Primary Examiner*—Frank T. Yost

*Attorney, Agent, or Firm*—Leitner, Palan, Martin & Bernstein

[57] ABSTRACT

A rolled material guide and cutter attachable to a pre-existing rolled material holder is provided. The rolled material guide and cutter comprises a pair of attachment members that attach to the brackets of the pre-existing roll holder, an interconnecting member between the pair of attachment members and a cover member pivotally connected to the attachment members. The cover member and interconnecting member form a channel through which the paper is guided. A tearing edge is provided to tear the material at the exit of the channel.

10 Claims, 6 Drawing Figures

ROLLED MATERIAL GUIDE AND CUTTER

BACKGROUND OF THE INVENTION

This invention relates to a rolled material guide and cutter that is attachable to pre-existing rolled material holders.

Conventional rolled material holders generally consist of two spaced brackets and a roller bar to hold the rolled material, the roller bar being supported between the two brackets. The conventional paper roll holder, such as a toilet paper roll holder used in the home, is generally of this type. The paper roll placed upon the roller bar in this type of holder can be easily rotated allowing the paper roll to unwind resulting in the free end hanging at some length from the paper roll. This hanging end is not only unattractive in an otherwise neat room but can be an attraction to small children or pets who delight in unrolling the remaining paper causing it to be wasted. The freely rotating paper roll is also a nuisance in that two hands must be employed to dispense and tear the desired length of the paper. One hand is needed to grasp and unroll the paper while the other hand is needed to hold the roll steady when the paper is torn. This is a problem when the holder is placed in an inconvenient location and can be a particular problem to the handicapped. Another problem associated with rolled material, particularly that which is manufactured to be soft and pliable as possible, is that the material clings to the roll. This makes the free end difficult to locate.

The prior art shows rolled material holders with both tearing edges and guiding means. However, these dispensers are designed to replace the entire holder. They are bulky, generally unattractive and relatively expensive to purchase and install. None of the prior art shows a simple inexpensive device that is readily and easily attached to the pre-existing roll holder.

SUMMARY OF THE INVENTION

The present invention overcomes the aforementioned disadvantages by providing a rolled material guide and cutter that is attachable to a pre-existing holder. The rolled material guide and cutter of the present invention consists of two interconnected attachment members that are attached to the pre-existing rolled material holder, and a cover member pivotally attached to the attachment members. The cover member in conjunction with the interconnection member of the attachment members forms a channel through which the material is guided. The cover member is provided with a locking tab to lock the pivotal cover member closed and to prevent lateral displacement of the cover member when the material is torn. The cover member is also provided with a tearing edge to facilitate the tearing of the rolled material. The interconnection member has a recessed portion to allow fingertip access to the free end of the material. Both the interconnection member and the cover member have raised projections that are interdigitized and form a tortuous path to prevent lateral displacement and entanglement of the material while the material is being torn.

OBJECTS OF THE INVENTION

Accordingly, an object of the present invention is the provision of a rolled material guide and cutter that is attachable to a pre-existing rolled material holder.

Another object of the present invention is the provision of a rolled material guide and cutter that is simple in construction and thus relatively inexpensive.

A further object of the present invention is the provision of a rolled material guide and cutter that keeps the end of the material readily accessible.

Stil another object of the present invention is the provision of a rolled material guide and cutter which maintains a neat and attractive appearance.

Other objects, advantages and novel features of the present invention will become apparent from the following detailed discription of the invention in conjunction with the accompanying drawings.

DESCRIPTION OF THE PREFERRED EMBODIMENT

Figure 1:
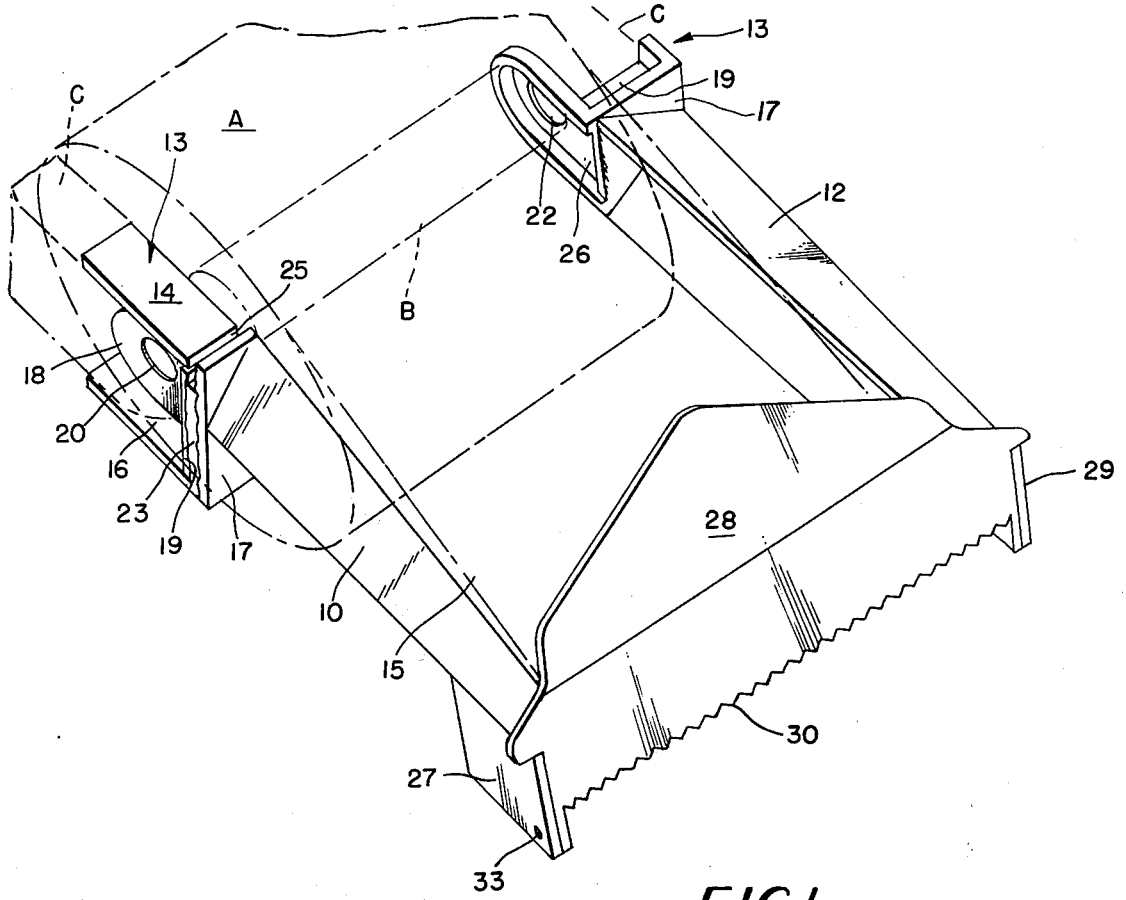
FIG. 1 is a perspective view of an embodiment of the rolled material guide and cutter of the present invention.

The rolled material guide and cutter of the present invention will now be described in connection with FIGS. 1 through 6. FIG. 1 shows a rolled material guide and cutter in conjunction with a material roll A, roller bar B and portions of the pre-existing brackets C. A, B and C are shown in phantom in FIG. 1 for sake of clarity. The rolled material guide and cutter is preferably of a molded plastic material but can be constructed of metal or other materials. Referring to the drawings, the material guide and cutter includes generally two spaced attachment members 10, 12 with downwardly projecting tabs 27, 29, an interconnecting member 11 and a cover member 28. The attachment members 10 and 12, tabs 27 and 29 and interconnection member 11 form a frame and are preferably molded as one piece, however, they may be molded individually with means to allow them to be snapped together. The snap together construction may be used to allow compact and thus economic packaging. The attachment members 10 and 12 are provided with means 13 to attach the attachment members 10 and 12 to the existing rolled material holder brackets C, shown in phantom in FIG. 1.

The attachment means 13 has a flat member 18 which is connected to member 17 which is connected to attachment member 10. Flat member 18 is provided with an opening 20 through which the end of the existing roller bar B extends to engage the existing bracket C. The flat member 18 is positioned between bracket C and the rolled material A is held in place by the roller bar B placed axially through the opening 20. Opposing flanges 14 and 16 of the attachment means 13 engage the top and bottom surfaces of the bracket C and prevent the guide and cutter from rotating relative to the holder when the material is torn. Also, the flanges 14 and 16 maintain the guide and cutter in a substantially horizontal position.

The flanges 14 and 16 may be molded on the attachment means 13 with a selected distance of separation to fit a specific existing rolled material holder. The preferred embodiment provides that flanges 14 and 16 are adjustable to enable the guide and cutter to fit various sizes of existing rolled material holder brackets.

Figure 2:
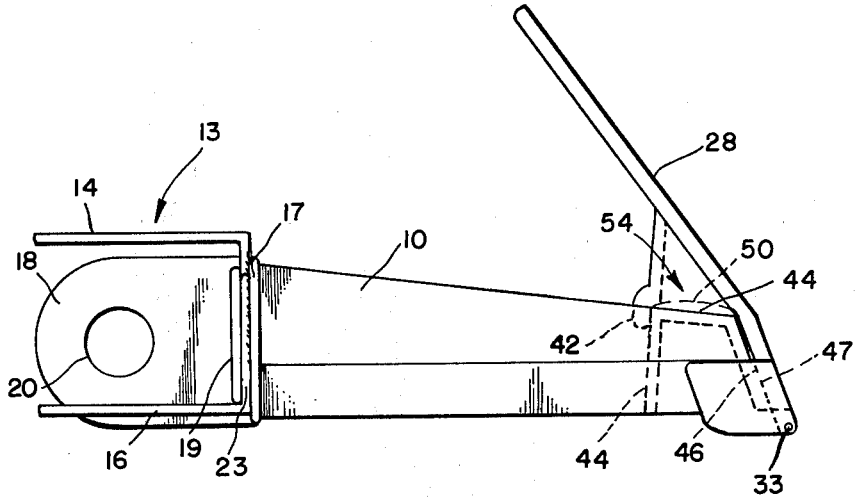
FIG. 2 shows a side view of the rolled material guide and cutter.
Figure 3:
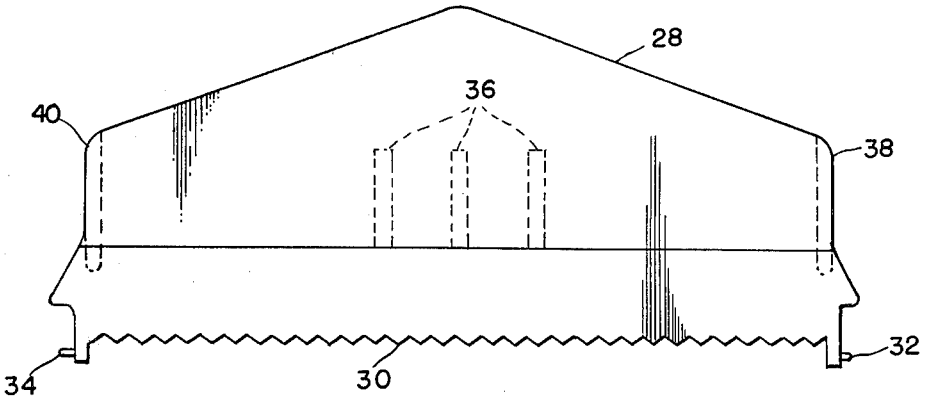
FIG. 3 shows the front view of the cover.
Figure 6:
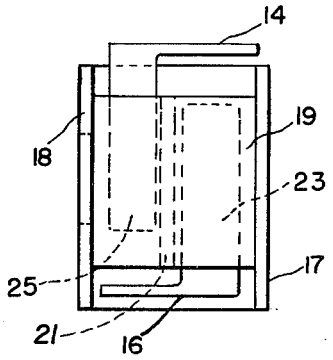
FIG. 6 shows the end view of the attachment means.

The adjustable construction can best be seen by referring to FIGS. 2 and 6 wherein the top flange 14 is shown in an extended position. The attachment means 13 has a pair of spaced flat members 17 and 19 connected together by a narrow rib 21. The rib 21, being generally centered, divides the space between flat members 17 and 19 into a pair of channels. The flanges 14 and 16 include an orthogonal projecting portion 25 and 23 respectively that are positioned in a respective channel between members 17 and 19. The preferred method for holding flanges 14 and 16 in position is by providing the surfaces between the orthogonal projections of flanges 14 and 16 and member 17 with a series of alternate raised and indented sections. By sliding the respective flange up or down so that the raised sections of the orthogonal projection of the respective flange coincide with the indented sections of member 17 a range of distances between the flanges 14 and 16 is provided. The space defined by the channels between members 17 and 19 is sized to allow the flanges 14 and 16 to be forceably raised or lowered. An alternate method for holding flanges 14 and 16 in position is by providing that the orthogonal projections 25 and 23 of flanges 14 and 16 are frictionally fit between members 17 and 19. In either method, the flanges 14 and 16 can be forceably moved apart or together to fit a variety of pre-existing rolled material holder brackets. Additionally, the flanges may also be removed completely to allow the guide and cutter to be attached to pre-existing rolled material holders that do not have brackets, i.e., the holder is of the sunken type with flat sides. In this case the flat surfaces 18 and 26 are positioned between the flat surface of the pre-existing holder and the rolled material and held in place by the roller bar B.

The cover member 28 is pivotally attached to the U-shaped frame consisting of the attachment members 10 and 12 and interconnecting member 11. The cover member 28 has projections 32 and 34 which mate with corresponding openings 33 in the tabs 27 and 29 of attachment members 10 and 12. The preferable pivoting means is as described above, however, other methods of pivotal attachment may be used, for example, a nut and bolt or equivalent. The cover member 28 is provided at each lateral edge with rearwardly projection sections 38 and 40 which terminate with locking tabs 42. The lower face of sections 38 and 40 rest against the upper face 44 of member 11 and locking tabs 42 extend over the rear edge of member 11 to frictionally lock the member 28 thereto. The outer edges of locking tabs 38 and 40 engage the inner edges of support members 12 and 10 respectively to provide lateral stability to the cover member 28 when the material is torn by pulling the material upward and to the side. The interlocking fit provided by locking tabs 38 and 40 counteract the forces caused by the tearing motion. The cover member 28 is aligned so that surfaces 46 and 47 of members 11 and 28 respectively and the area between the rear face of member 28 and the upper face of member 11 define a channel 54 through which the material passes.

The cover member 28 is also provided with a plurality of projections 36 which interact with a plurality of projections 50 from member 11 to provide a tortuous path for the rolled material. The projections 36 and 50 extend into channel 54 and alternate spacially. The tortuous path thus formed prevents lateral movement and entangling of the material when the material is torn.

The cover member 28 is further provided with a serrated edge 30 to cut the rolled material or aid in tearing perforated rolled material. The preferable embodiment entails a serrated edge being molded into the plastic material, however, it is appreciated that other tearing edges may be provided, such as a metal toothed edge secured by means such as rivets, screws, etc., or the tearing edge may be a flat edge for tearing perforated or thin sheet material.

Figure 4:
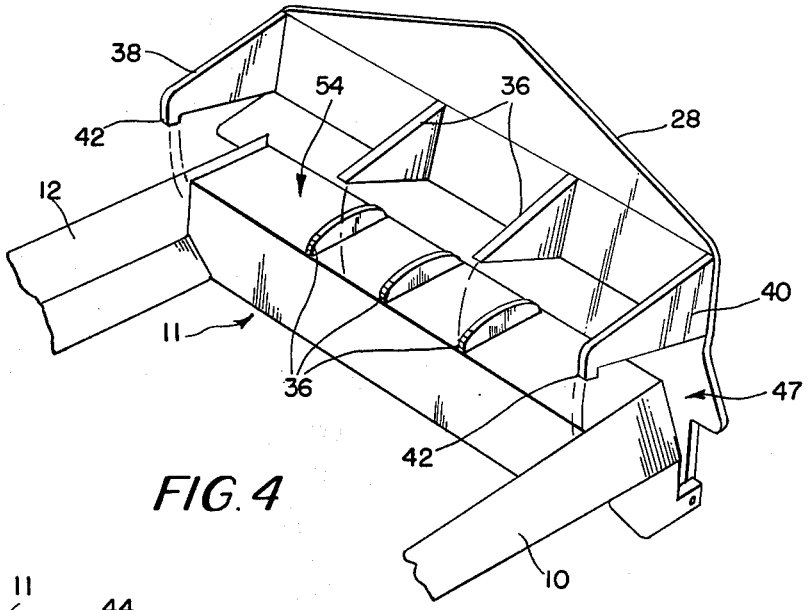
FIG. 4 shows the cover in the open position.
Figure 5:
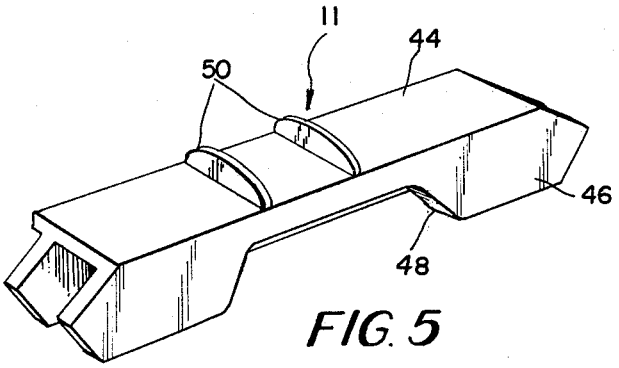
FIG. 5 shows the interconnecting member.

The attachment of the rolled material guide and cutter to the pre-existing holder will now be described. The rolled material is placed upon the roller bar B and the ends of the roller bar are positioned in openings 20 and 22 provided in the attachment means 13. The cover member 28 is rotated forward into the open position as shown in FIG. 4. The free end of the rolled material is fed through channel 54 so that it is positioned directly behind cutting edge 30. The cover member 28 is then rotated back into the closed position shown in FIG. 2 and locked with locking tabs 42. The ends of the roller bar B are then placed in the openings provided in the brackets of the pre-existing rolled material holder to mount the combination thereto. The opposing flange 14 and 16, if adjustable, are adjusted to snugly engage the top and bottom surfaces of bracket C to stabilize the guide and cutter.

To obtain a portion of the rolled material the fingers are inserted into recess 48, which is positioned directly behind the tearing edge 30, the material grasped against the face 47 of member 28 and pulled outward until the desired length is obtained. The material is then torn by a simultaneous upward and sideways motion. The material is torn neatly by tearing edge 30 and is prevented from freely unwinding or re-rolling by the action of the restriction imposed by the channel 54 and the tortuous path provided by projections 36 and 50. Projections 36 and 50 also prevent lateral motion of the material and thus prevent the material from entangling by bunching at one side of the guide as a result of the sideways motion.

Thus, a new and novel rolled material guide and cutter is provided that is easily attachable to pre-existing rolled material holders. Although the above description related to a pre-existing holder mounted in a horizontal position it can be appreciated that the present invention is applicable for other mounting positions, for example, a vertical mounting. It can be appreciated that the guide and cutter is of simple construction and thus inexpensive to manufacture and that alternate constructions would be feasible and equally inexpensive. For example, the triangular cross section of supports 10 and 20 was selected for the strength and stability it provides. However, other cross sectional designs could be used without defeating the utility of this invention. Furthermore, it will be appreciated that the present invention can be molded in various designer colors and that designs can be molded into the separate members. Additionally, the cover member 28 is shown as an extended cover, however, the cover may be shortened, elongated or molded in various shapes without changing its utility. Finally, the rolled material guide and cutter of the present invention provides a positive tearing action and maintains the paper in a readily accessible position.

Although the invention has been described and illustrated in detail, it is to be clearly understood that the same is by way of illustration and example only and is not to be taken by way of limitation, the spirit and scope of the invention being limited only to the terms of the appended claims.

What is claimed:

1. A rolled material guide and cutter attachable to a pre-existing rolled material holder, comprising:

a U-shaped frame including attachment means for attaching said guide and cutter to said pre-existing rolled material holder;

cover means pivotally attached to said frame, said cover means in conjunction with said frame forming a channel through which a rolled material is guided; and means for providing a tortuous path in said channel for preventing lateral slippage and entanglement of said rolled material.

2. A rolled material guide and cutter as provided in claim 1 wherein the bight portion of said U-shaped frame includes a recess for keeping the free end of said rolled material readily accessible.

3. A rolled material guide and cutter as provided in claim 1 wherein said means for providing a tortuous path in said channel comprise projections extending into said channel, said projections alternating spacially and interacting to form said tortuous path.

4. A rolled material guide and cutter as provided in claim 1 wherein said cover means includes means for locking said cover means to said frame to prevent pivoting.

5. A rolled material guide and cutter as provided in claim 1 wherein said frame includes a serrated edge for cutting said rolled material.

6. A rolled material guide and cutter attachable to a pre-existing rolled material holder, comprising:

a U-shaped frame including attachment means for attaching said guide and cutter to said pre-existing rolled material holder and preventing the guide and cutter from rotating relative to said holder;

said attachment means including adjustable flange means for accommodating said attachment means to various sizes of said pre-existing rolled material holders while preventing rotation of the guide and cutter relative to said holder.

7. A rolled material guide and cutter as provided in claim 6 wherein the adjustable flange means comprises a pair of opposing flanges.

8. A rolled material guide and cutter attachable to a pre-existing rolled material holder, comprising:

a U-shaped frame including attachment means for attaching said guide and cutter to said pre-existing rolled material holder;

said attachment means including adjusting means for fitting said attachment means to various sizes of said pre-existing rolled material holders;

said adjusting means comprising movable opposing flanges;

said flanges provided with means for inhibiting movement of said flanges after said flanges are positioned to fit said pre-existing rolled material holder.

9. A rolled material guide and cutter as provided in claim 8 wherein said means for inhibiting movement of said flanges comprises a series of alternate raised and indented sections on said flanges and said attachment means.

10. A rolled material guide and cutter as provided in claim 8 wherein said means for inhibiting movement of said flanges comprises providing a frictional fit between said flanges and said attachment means.

* * * * *